United States Patent [19]

Collins

[11] 4,064,953

[45] Dec. 27, 1977

[54] SHEAR SUB FOR DRILL STRING

[75] Inventor: Kenneth L. Collins, Berwick, La.

[73] Assignee: Gulf Oil Corporation, Pittsburgh, Pa.

[21] Appl. No.: 698,328

[22] Filed: June 22, 1976

[51] Int. Cl.[2] ..... E21B 41/00

[52] U.S. Cl. ..... 175/321; 64/28 R; 175/294; 285/2; 285/3

[58] Field of Search ..... 175/294, 320, 321; 64/28 R; 285/2, 3, 4; 403/2

[56] References Cited

U.S. PATENT DOCUMENTS

| | | | |
|---|---|---|---|
| 2,422,223 | 6/1947 | Church | 285/3 |
| 2,500,276 | 3/1950 | Church | 285/2 |

*Primary Examiner*—Ernest R. Purser
*Assistant Examiner*—William F. Pate, III

[57] ABSTRACT

A shear sub for installation in the drill string used to rotate a drill bit in the drilling of wells includes a mandrel extending upwardly for connection to the drill string. A housing slidably enclosing the mandrel extends downwardly below the mandrel and is threaded for connection directly, or indirectly, through joints of drill pipe to the drill bit. Rotation and longitudinal movement of the housing relative to the mandrel during drilling is prevented by shear pins which engage the housing and the mandrel to hold the housing in a position in which lugs extending inwardly therefrom are directly above and in alignment with splines extending outwardly from the mandrel. If an obstruction to drilling occurs that results in excessive torque on the drill string, the shear pins are sheared. On lifting and rotating the drill string, the mandrel moves upwardly relative to the housing whereupon the lugs interlock with the splines to allow rotation of the drill bit as it is lifted off bottom.

5 Claims, 4 Drawing Figures

SHEAR SUB FOR DRILL STRING

BACKGROUND OF THE INVENTION

1. Field of the Invention

This invention relates to the drilling of wells and more particularly to apparatus to be installed in a drill string to protect the drill string during drilling operations.

2. Description of the Prior Art

During the drilling of a well, the torque required to rotate the drill string may become excessive for any of a number of reasons such as wear of the drill bit, junk in the hole or highly fractured formations collapsing on the drill string. The excessive torque may cause twistoff of the drill string and result in an expensive fishing operation or abandonment of the hole. Because the torque is applied to the drill string throughout its length above the location at which the obstruction to rotation occurs and the obstruction is most frequently near the bottom of the borehole, any weakness in the drill string at any point along its full length above the obstruction increases the chances of a twistoff.

U.S. Pat. No. 1,923,132 of Witkin and U.S. Pat. No. 1,610,414 of Bernard et al describe a safety joint to be installed in and constitute a part of the drill string to prevent applying excessive torque to the drill string. The safety joint described in each of the patents includes a lower portion that is rotatably suspended from an upper portion. During drilling, relative rotation of the two portions of the sub is prevented by shear pins which are sheared when the torque required to rotate the drill string becomes excessive. The apparatus described in U.S. Pat. Nos. 1,610,414 and 1,923,132 provides protection for the drill string but does not allow any rotation of the drill bit after the shear pins have been broken. Sometimes rotation of the drill bit is necessary to clear the hole and for removal of the drill string after an obstruction to drilling is encountered.

U.S. Pat. No. 3,204,992 of Walker and U.S. Pat. No. 2,532,686 of Ware describe safety joints to be installed in a drill string or other tubing which allows separation of the drill string or tube at the safety joint in the event the drill string or tubing becomes stuck in the hole or the torque required to rotate the drill string becomes excessive. In the apparatus described in U.S. Pat. Nos. 2,532,686 and 3,204,992 it is necessary for the operators to recognize that the drill string or tubing has become stuck. The apparatus does not provide means for automatically preventing the application of excessive torque throughout the length of the drill string or tubing; consequently does not provide protection against twistoffs.

SUMMARY OF THE INVENTION

This invention resides in a shear sub to be installed in a drill string that includes a mandrel connected to the drill string above the sub. The mandrel is slidably and rotatably enclosed within a housing that is connected to a lower portion of the drill string. During drilling, the mandrel and housing are held by shear pins in a set position with lugs extending inwardly from the housing positioned directly above and out of engagement with splines extending outwardly from the mandrel. If excessive torque is applied to the drill string, the shear pins are sheared. On lifting and rotating the drill string, the mandrel rises relative to the housing and the lugs engage the splines of the mandrel to rotate that part of the drill string below the shear sub.

DESCRIPTION OF PREFERRED EMBODIMENT

Figure 1:
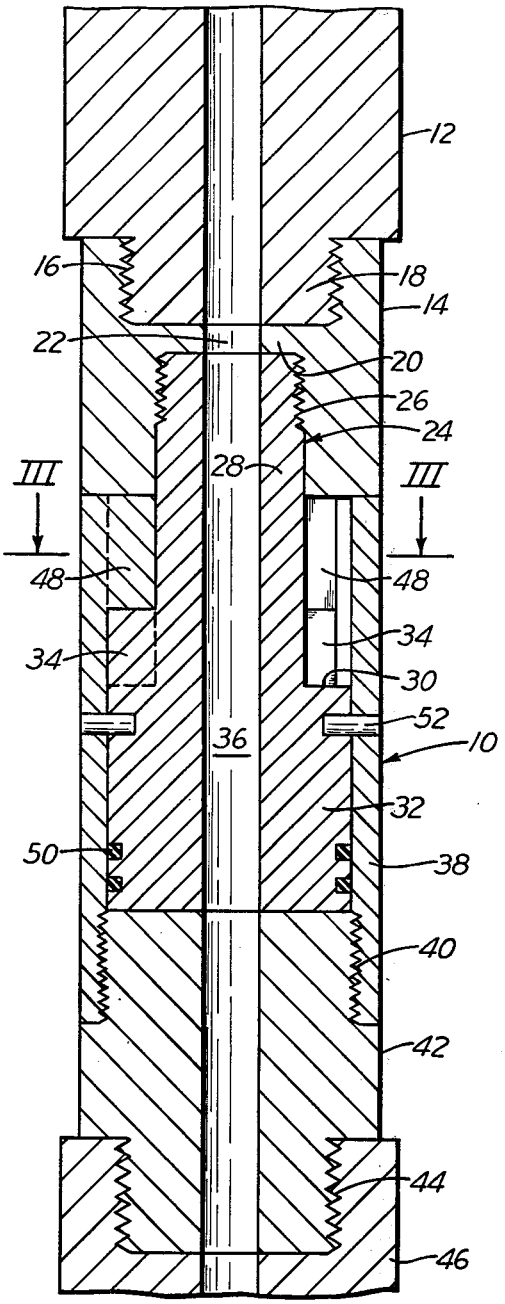
FIG. 1 is a vertical sectional view of the shear sub in the set position for drilling.

Referring to FIG. 1 of the drawings, a shear sub indicated generally by reference numeral 10 is shown connected to a drill collar 12 at the lower end of a drill string. The connection is made by a top coupling 14 shown having internal threads 16 at its upper end for connection to a pin 18 at the lower end of drill collar 12. In the embodiment shown, coupling 14 has an inwardly extending flange 20 near the midpoint thereof. A central opening 22 through the flange serves as a continuation of the passage through the drill string for the circulation of drilling mud to the drill bit. The central opening through the coupling is enlarged both above and below flange 20 and is internally threaded at 16 below the flange to receive a tubular mandrel indicated generally by reference numeral 24 which forms a part of the shear sub 10.

A neck 28 extends upwardly from shoulders 30 at the upper end of a body 32 of the mandrel. A plurality of spaced-apart splines 34 protrude outwardly from the neck immediately above the shoulders 30. A central passage 36 longitudinally through the mandrel 24 allows circulation of drilling mud to the drill bit.

Slidable longitudinally and rotatable on the outer surface of the body 32 of mandrel 24 is a housing 38. Housing 38 is internally threaded at 40 at its lower end for connection to a bushing 42. Bushing 42 is illustrated having external threads 44 for connection to a drill bit either directly or through a suitable coupling such as 46.

Extending inwardly from the housing 38 at its upper end toward the neck 26 of the mandrel are a plurality of lugs 48. The number and spacing of lugs 48 is preferably the same as the number and spacing of the splines 34. Although a single lug and a single spline would be operable, it is preferred that a plurality of splines and lugs be provided at uniform intervals around the neck 26 separated by spaces only slightly wider than the width of the lugs and splines to improve the stability of the shear sub. Ring seals 50 are embedded in grooves on the outer surface of the body 32 of the mandrel to engage the inner surface of the housing and prevent leakage of drilling mud between the housing and mandrel.

Figure 3:
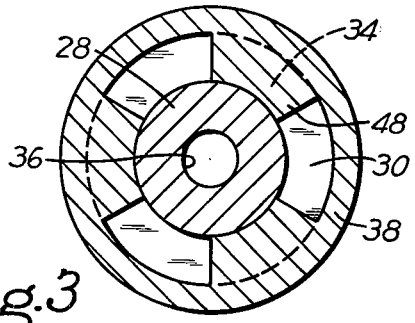
FIG. 3 is a horizontal sectional view taken along the section line III—III in FIG. 1.
Figure 4:
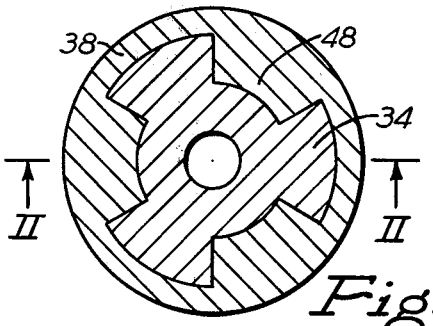
FIG. 4 is a horizontal sectional view taken along the section line IV—IV in FIG. 2.

In the operation of the shear sub of this invention, the mandrel is assembled within the housing in the set position shown in FIG. 1 and FIG. 3 with the lugs 48 of the housing directly above and in alignment with the splines 34. The upper end of the housing preferably bears against the lower end of coupling 14. The housing and mandrel are held in the set position solely by shear pins 52 in that the lugs 48 and splines 34 do not interlock. The assembled sub is connected in the drill string, preferably immediately above the drill bit, and lowered into the borehole of the well. Drilling mud is circulated down the central passage through the drill collars, mandrel and couplings to the drill bit and the drill string rotated in the conventional manner. The mandrel, being connected by threads to the lower end of the drill collar 12, is rotated with the drill string, and such rotation is transmitted to the housing 38 through the shear pins 52. The threaded connection 40 of the housing 38 to the coupling 42 transmits the rotary motion to that portion of the drill string below the shear sub 10.

Figure 2:
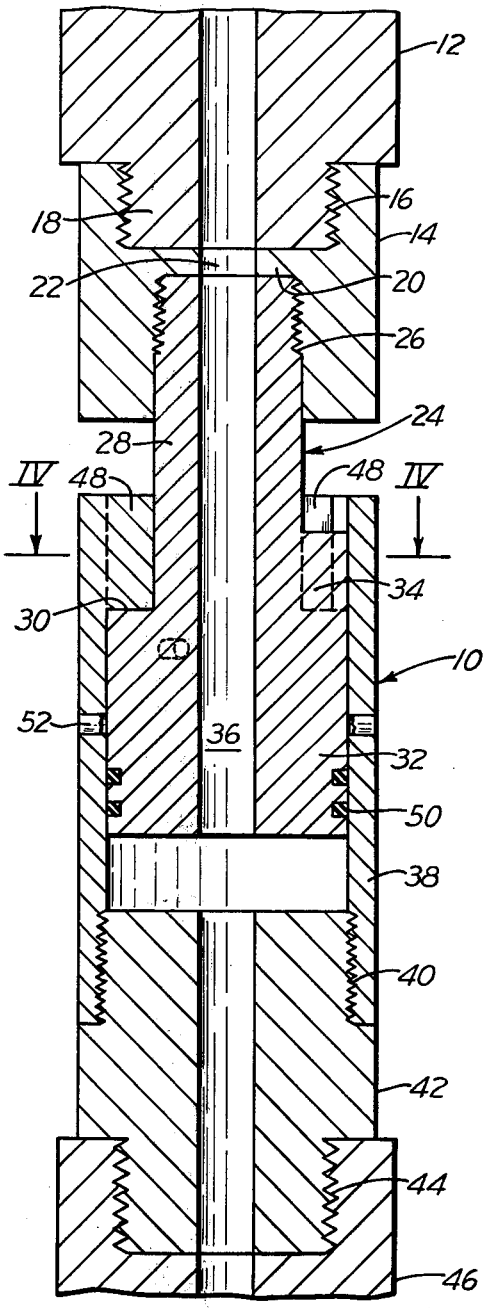
FIG. 2 is a vertical sectional view of the shear sub in the sheared position with the mandrel lifted to a raised position in which the lugs on the housing engage the mandrel splines.

If the drill bit should, for example, become worn and lose a bearing for a cutter cone, or should encounter any obstruction which resists rotation and increases the torque required to rotate the bit above a predetermined maximum, the shear pins 52 are sheared and the torque is then not transferred from the drill string through the shear sub to the drill bit. If it is desired to pull the bit from the hole, lifting the drill string while rotating the drill string will cause the splines 34 to move into the spaces between the lugs 48 and the mandrel to rise relative to the housing to the position shown in FIG. 2. At that position the shoulders 30 engage the lower surface of the lugs 48 to lift the shear sub and the equipment attached to its lower end from the hole. Engagement of the lugs 48 with the splines 34 allows the drill bit to be rotated, if desired, as the bit is raised off bottom.

The shear sub of this invention provides an inexpensive means for instantly and automatically reducing the torque on the drill string above the shear sub whenever there is any obstruction below the sub to rotation of the drill string. The shear pins not only serve to transmit torque from the drill string to the drill bit but hold the lugs on the housing above the splines on the mandrel to prevent their interlocking. Because the housing is slidable longitudinally, as well as rotatable, on the mandrel, the lugs and splines can move to an interlocking position to allow rotation of the drill bit as it is lifted off bottom.

The arrangement of the lugs from the housing and the splines on the mandrel in vertical alignment when the sub is in the set position provides a rugged structure well able to carry the weight of the drill collars and drill string applied to the bit. The wall thickness of the coupling into which the neck of the mandrel is screwed applies the weight across the entire horizontal surface of the lugs as well as of the housing. The housing is, therefore, firmly supported and capable of withstanding the weight of the load applied to the drill bit. Positioning of the splines directly below the lugs makes certain that the torsion forces are carried entirely by the shear means.

In the embodiment of this invention described with reference to the drawings, the shear sub is installed between the bottom drill collar and the drill bit. That arrangement is particularly advantageous when it is contemplated the obstruction or resistance to rotation is most likely to develop at the drill bit. It is not however essential that the shear sub be installed at the lower end of the drill string. It may, for example, be connected in the drill string directly below the kelly. If a directional hole is to be drilled, the principal resistance to rotation of the drill string may be at a midpoint, for example near or at a whipstock, and the shear sub may then be most advantageously connected in the drill string at a midpoint.

I claim:

1. A shear sub for installation in a drill string for drilling wells between an upper portion and a lower portion thereof comprising:

a. a tubular mandrel having a cylindrical body and a neck extending vertically from said body, b. said tubular mandrel being connected to one of said upper portion and said lower portion of the drill string for movement unitarily therewith, c. a cylindrical housing enclosing the body movable rotatively and limitedly longitudinally on the outer surface of the body of the tubular mandrel, d. said housing being securely connected to the portion of the drill string other than the portion to which the mandrel is connected, e. spaced-apart lugs extending inwardly from the housing toward the neck, f. spaced-apart splines protruding from the mandrel between the neck and the housing, g. and shear means rupturable by torque engaging the housing and mandrel to hold the housing and mandrel in a set position with the lugs disengaged from the splines, h. the spacing of the lugs and splines allowing movement of the lugs into spaces between the splines on shearing of the shear means.

2. A shear sub as set forth in claim 1 characterized by sealing means around the body of the mandrel adapted to engage the housing and prevent leaking between the housing and the mandrel.

3. A shear sub as set forth in claim 1 characterized by the neck extending upwardly from the body of the tubular mandrel and being connected to the upper portion of the drill string.

4. A shear sub as set forth in claim 3 characterized by the neck having external threads at its upper end, and an internally threaded coupling connected at its lower end to the upper end of the neck and at its upper end to the upper portion of the drill string, said coupling having an outer diameter at least as large as the outer diameter of the housing.

5. A shear sub as set forth in claim 3 characterized by the upper end of the lugs and the upper end of the housing being in the same plane and the upper end of the splines engaging the lower end of the lugs when the housing and mandrel are in the set position.

* * * * *